US005252076A

United States Patent [19]

Kelleher

[11] Patent Number: 5,252,076

[45] Date of Patent: Oct. 12, 1993

[54] METHOD AND APPARATUS FOR TRAINING ATHLETES

[76] Inventor: Daniel S. Kelleher, 201 E. 9th, Ellensburg, Wash. 98926

[21] Appl. No.: 745,064

[22] Filed: Aug. 13, 1991

[51] Int. Cl.[5] ..... A63B 69/00

[52] U.S. Cl. ..... 434/251; 273/55 R

[58] Field of Search ..... 434/247, 251; 273/26 A, 273/29 A, 55 D, 55 R, 391; 343/880, 881, 883; 404/6, 9, 10, 12, 11, 13; 482/15, 16, 36

[56] References Cited

U.S. PATENT DOCUMENTS

| | | | |
|---|---|---|---|
| 2,200,338 | 5/1940 | Mason | 343/880 |
| 2,443,131 | 6/1948 | Fessler | 434/247 X |
| 2,881,543 | 4/1959 | De Rowen | 273/55 R |
| 2,978,246 | 4/1961 | Van Groningen | 273/26 A |
| 3,194,556 | 7/1965 | Vinson | 273/26 A |
| 3,279,133 | 10/1966 | De Korte | 404/10 |
| 3,814,416 | 6/1974 | Munger et al. | 482/36 |
| 3,868,108 | 2/1975 | Kirchner . | |
| 4,183,695 | 1/1980 | Wilcox | 482/16 X |
| 4,208,050 | 6/1980 | Perrine et al. . | |
| 4,252,313 | 2/1981 | Skalka | 482/36 |
| 4,342,459 | 8/1982 | Pretorius . | |
| 4,936,578 | 6/1990 | Hudson | 273/55 R |
| 4,961,587 | 10/1990 | Galvin . | |
| 5,028,166 | 7/1991 | Leishman | 404/10 |

FOREIGN PATENT DOCUMENTS

| | | | |
|---|---|---|---|
| 2640151 | 6/1990 | France | 434/247 |

*Primary Examiner*—V. Millin
*Assistant Examiner*—William E. Stoll
*Attorney, Agent, or Firm*—Stratton Ballew Richardson

[57] ABSTRACT

An apparatus for training athletes to improve their ability to concentrate on, track, and handle or catch a ball in motion with at least one central elongated body, a plurality of barrier arms for each elongated body with the barrier arms extending outward from and being arrayed along the central elongated body, and a mounting system for each central elongated body that is attached to and holds each central elongated body upright in substantially vertical position without the use of external supports. Barrier arms are made of flexible material. A method for training athletes and improving their ability to concentrate on, track, and handle or catch a ball in motion is also disclosed.

11 Claims, 10 Drawing Sheets

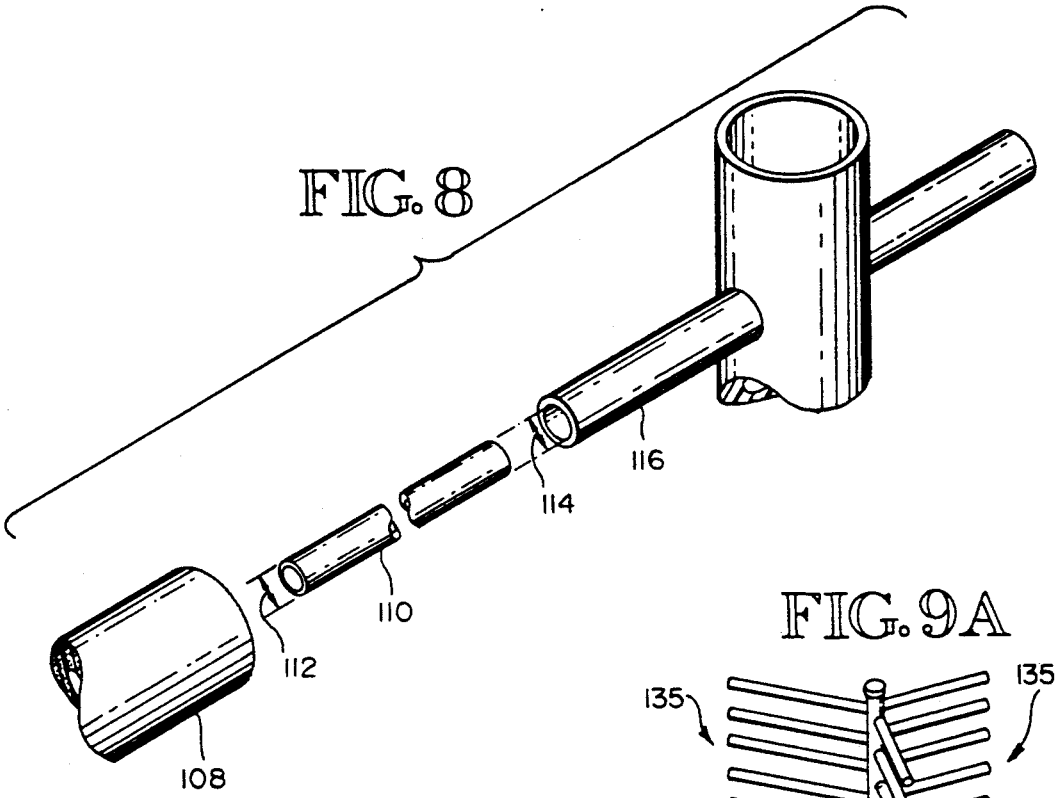
FIG. 8
FIG. 9A
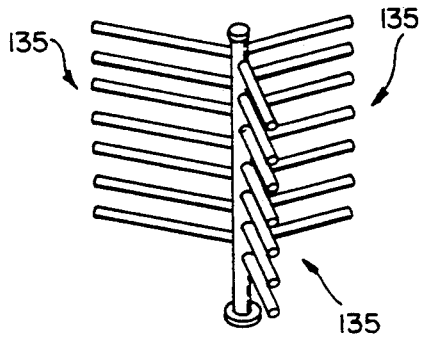
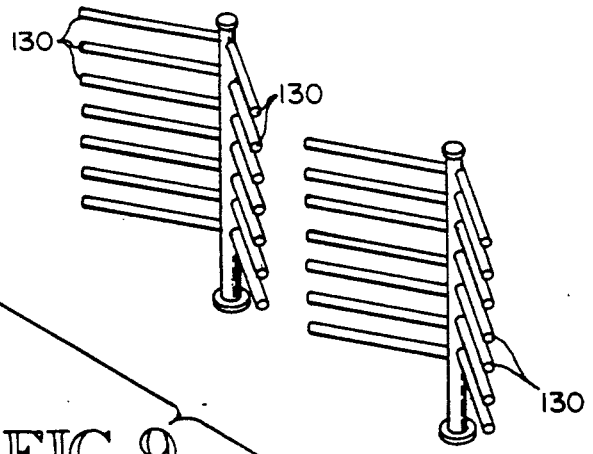
FIG. 9

METHOD AND APPARATUS FOR TRAINING ATHLETES

TECHNICAL FIELD

The present invention relates to an apparatus and method for training athletes to improve their ability to concentrate on, track, and handle or catch a ball in motion. More particularly, both method and apparatus involve obscuring the athlete's vision while deflecting the ball in flight, thereby minimizing the reaction time available to the athlete to handle or catch the ball.

BACKGROUND OF THE INVENTION

One of the ongoing problems in training athletes in sports which require the handling and/or catching of a ball, such as football, basketball, soccer, and baseball, is teaching the athlete to track a ball in motion and react quickly to unexpected deflections of the path of the ball, preferably with their hands.

Defenders employ a dual strategy of first attempting to impair the vision of offensive players attempting to handle or receive the ball in motion, and secondly to deflect or intercept the ball if possible. The offensive player is put in a position of double jeopardy. First, his ability to track the ball in motion is impaired which in and of itself limits the time he has to react and handle or catch the ball. Further, if the defender is successful in deflecting the ball, the offensive player has even less time to react to the change in the path of the ball.

In addition to deflections caused by opposing players, the ball in motion may be deflected by playing surface imperfections, or the shape of the ball. Since the advent of these sports, various techniques have been used in an attempt to improve and maximize a player's ability to track, and then to handle or catch the ball.

One of the problems associated with attempting to increase a receiver's or handler's skill level involves the use of that person's hands. There is a tendency among athletes to "catch" a ball with their body, then wrap their arms around the ball. The preferable method in a strict athletic sense is for the receiver to use his hands which provide the surer reception and allow a quicker reaction to unexpected changes in the flight of the ball. In order for the player to use his hands to catch or handle the ball, a high level of concentration, as well as correct hand placement prior to the reception, is required.

A number of training techniques have been developed in attempts to train athletes to better handle or catch balls in motion. Most often, the technique used has been a practice drill which requires at least three players. The first player is the one who throws or kicks the ball. The second player acts as a defender who actively attempts to prevent the successful handling or catching of the ball. The third player, the object of the drill, is attempting to successfully complete the handling or catching of the ball. A typical example of such a drill is a receiver's drill in football in which the quarterback passes the football to the receiver at the end of the prescribed run with a third person acting as the defender. The defender places his hands in front of the receiver to impair the receiver's vision. The defender also may or may not attempt to intercept or deflect the ball to prevent the receiver from catching it.

This technique has several drawbacks. First, it requires at least three players. Also, the players acting as quarterback and defender must have skill levels that allow them not only to simply complete the drill, but also to challenge the receiver and increase his skill levels. Finally, the player acting as defender frequently is an offensive player, since defensive players usually are taking part in other drills This reduces the number of times a player can run a drill since offensive players are required to play defender instead taking part in the offensive training portion of the drill.

The use of a live defender does not necessarily improve the receiver's tracking ability, his concentration, or his ability to use his hands to catch or handle the ball. A practice defender has a difficult time attempting to recreate game conditions during training exercise. Since the defender knows the drill to be run, the defender tends to cause disruptions in the completion of the pass, and deflections of the ball that do not realistically reflect what typically happens in an actual game. In an actual game, the defender is frequently lunging or rushing to prevent the pass from being completed. In this situation, the defender frequently will cause only a minor deflection in the ball's path by grazing it. In any circumstance, the effect of the defender on the ball is unpredictable. In the practice situation, where the defender is already aware of the direction in which the ball is going to be thrown, the defender's placement and reaction to the ball is artificial and prevents both the pass receiver and the defender from running a realistic drill at full speed. At the same time, the drill does not place emphasis on improving the athlete's concentration on the ball, and the placement and use of his hands to catch the ball.

While this discussion has concentrated on the forward pass thrown by a quarterback to a receiver, as an example, it is equally applicable in football to a running back who must learn to receive a lateral or shovel pass. Other sports having similar requirements of athletes for handling or catching balls are basketball, where players must learn to pass, catch, and rebound in a crowd near or under the basketball goal while being defended; the soccer player who handles the ball with his feet; the soccer goalie who in fact handles the ball with his hands; and the baseball player who must learn to field a baseball cleanly, even when the baseball is deflected by a rough edge between the infield and the base path for example.

As can be seen from the above discussion, there are a number of desirable characteristics for an apparatus to train athletes. It would be desirable to have an apparatus to train athletes who handle or catch balls that minimizes the personnel needed to execute drills. It also would be desirable to have an apparatus for the training of receivers and ball handlers that causes athletes to concentrate on tracking the ball and using their hands. Further, it would be desirable to have an apparatus for training athletes to catch or handle balls which would allow ball handling training drills to be repeated multiple times in a predictable fashion, while causing the ball itself to be deflected in an unpredictable manner. Additionally, it would be desirable to have an apparatus to train athletes to catch or handle balls, that could be easily moved, set up, and used. It also would be desirable to have an apparatus for training athletes to catch or handle balls which would be adaptable for a variety of training drills. It further would be desirable to have a method for training athletes to improve their ability to concentrate on, track, and catch a ball in motion with their hands. It additionally would be desirable to have a method for training athletes to handle or catch balls in motion that is predictably repeatable. It would also be desirable to have a method for training athletes to handle or catch balls in motion, that can travel with the athlete to remote locations.

While the discussion here relates to apparata and methods for training athletes to catch or handle balls, it is not intended that the invention be limited to this situation. It will be obvious from the description that follows that the present invention will be useful in other applications with problems common to those described herein.

SUMMARY OF THE INVENTION

It is the object of the present invention to provide an athletic training apparatus which improves the athlete's ability to track, and catch or handle balls in flight.

It is also the object of the present invention to provide an athletic training apparatus which minimizes the number of people needed to execute ball handling training drills for athletes.

It is a further object of the present invention to provide an athletic training apparatus that is easily moved, set up, and used.

It is yet another object of the present invention to have an athletic training apparatus which allows training drills to be repeated in a predictable fashion.

It is another object of the present invention to provide an athletic training apparatus that is easily packaged, assembled, disassembled, repackaged and transported.

It is an additional object of the present invention to provide an athletic training apparatus that is relatively lightweight and inexpensive both to manufacture and use.

It is yet a further object of the present invention to provide a training method for improving an athlete's ability to concentrate on, track, and handle or catch a ball with his hands.

It is also an object of the present invention to provide a training method for improving an athlete's ability to concentrate on, track, and handle or catch balls in flight, that can travel with the athletes to remote locations.

The present invention achieves these and other objectives, which will become apparent from the description that follows by providing an apparatus with at least one vertically oriented, central elongated body which has extending from it and arrayed along its length a plurality of flexible barrier arms. The barrier arms are affixed to and arrayed along the central elongated body. There also is a mounting system which attaches to the central elongated body and which allows it to stand in its substantially vertical orientation without external attachments or supports.

An alternative preferred embodiment of the present invention uses two sets of barrier arms attached to and arrayed along a central elongated body so that their length is substantially normal to the central elongated body length. In this preferred embodiment the two sets of barrier arms extend from the central elongated body in directions opposite one another. In this embodiment, the arms can be attached to the central elongated body in a detachable manner by an arm attachment system. This can be done by friction attachments or by the use of separate affixing systems such as hook and loop materials or binding mechanisms.

An additional preferred alternative embodiment of the present invention uses multiple central elongated bodies with each central elongated body having sets of arms attached and extending from it. In this embodiment, the central elongated bodies are placed proximate one another so that the ends of the barrier arms of adjacent central elongated bodies meet, or nearly meet, having a curtain effect.

A further alternative preferred embodiment of the present invention is substantially similar to the above described embodiments. In this preferred embodiment, however, the barrier arm is detachable and the central elongated body is broken into separate pieces so that it can be easily portable in a bag to be carried by an individual.

Another alternative preferred embodiment of the present invention is a method for improving an athlete's ability to handle and catch balls in motion. The method includes the following steps: placing a stationary object on the field where the practice is to take place; throwing or kicking a ball in a specified direction; obstructing the athlete's vision of the ball in motion with the stationary object; deflecting the ball in motion with the stationary object; and having the athlete preposition his hands to handle or catch the ball successfully.

BRIEF DESCRIPTION OF THE DRAWINGS

FIG. 8 is a partial, exploded perspective view of an alternative preferred embodiment constructed in accordance with the present invention.

FIG. 9 is a perspective view of a eighth alternative preferred embodiment constructed in accordance with the present invention.

FIG. 9A is a perspective environmental view of a nineth alternative preferred embodiment constructed in accordance with the present invention.

DETAILED DESCRIPTION OF THE PREFERRED EMBODIMENTS

Figure 1:
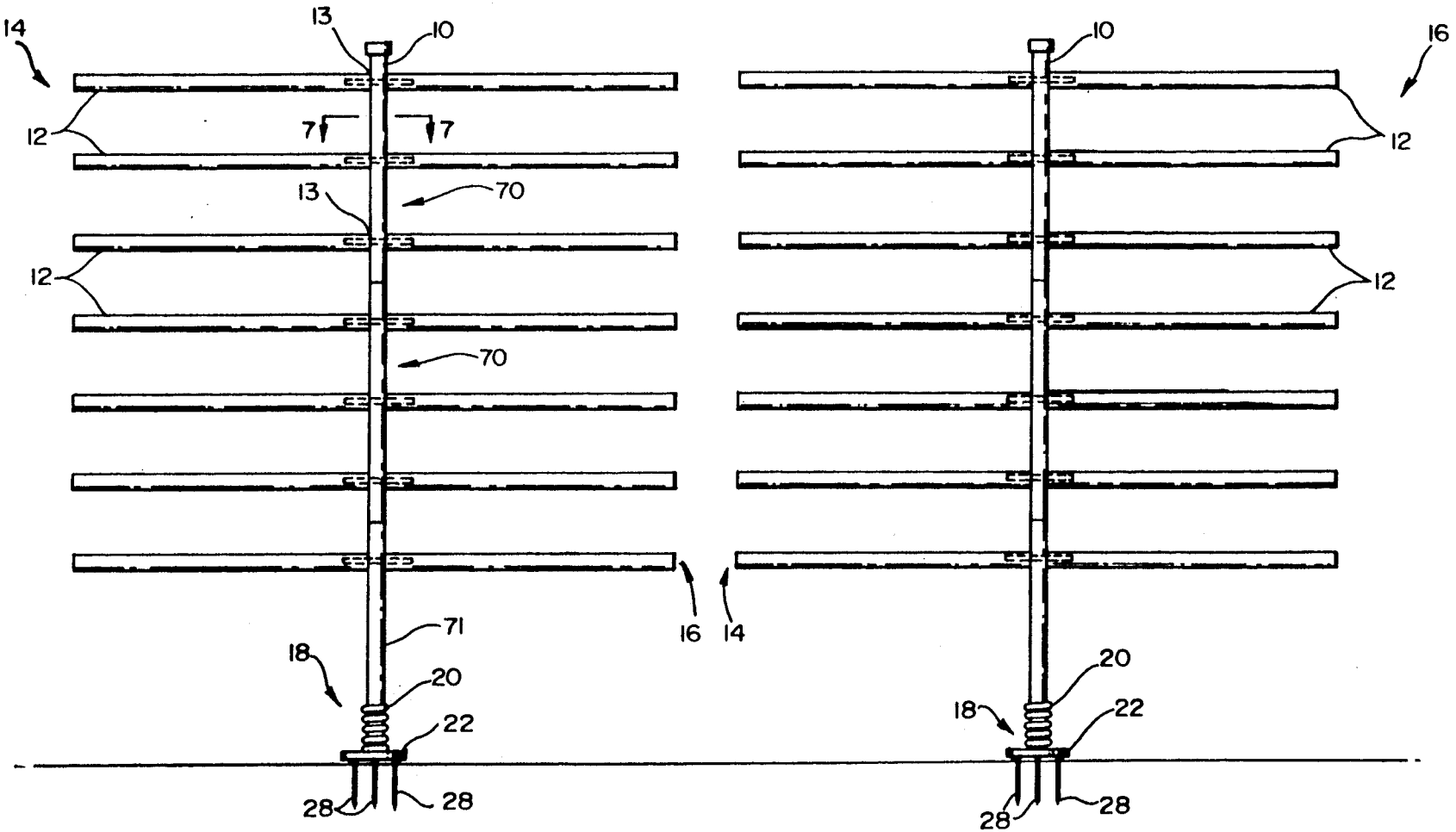
FIG. 1 is a side elevation view of a preferred embodiment constructed in accordance with the present invention.

With reference to FIG. 1, a vertically oriented central elongated body 10 is shown with a plurality of barrier arms 12 extending from and arrayed along a central elongated body. These barrier arms are organized into a first set 14 and a second set 16 of barrier arms. As can clearly be seen from FIG. 1, the barrier arms making up the first set extend outward from the central elongated body substantially opposite the barrier arms making up the second set.

The central elongated body itself is held in the upright position by a mounting system 18. This mounting system is made up of a mounting spring 20, a mounting plate 22, a fastening bracket 24, and a fastening nut 26. Extending downward from the mounting plate are a plurality of spikes 28. The mounting spring is held in place on the mounting plate by the fastening bracket which has raised ends 30 which fit over the bottom coil of the spring. The mounting spring is oriented with an open end 31 directed upward. The fastening nut in turn tightens the fastening bracket to the mounting plate. At the bottom 32 of the central elongated body small slots 33 are cut out. These slots enable the central elongated body bottom to straddle the fastening bracket when one end 33 of the central elongated body is slid into the open end of the mounting spring. This helps the mounting system to hold the central elongated body in place and prevent it from rotating relative to the mounting system.

In addition to holding the central elongated body 10 upright, the mounting spring 20 serves other functions. It enhances the safety of the athletes using the apparatus by allowing the central elongated body to yield when an athlete collides with it during a drill. By the same token, the life of the apparatus is extended by yielding during impact instead of breaking or tipping over.

The mounting plate, spikes, and and fastening bracket can be made out of any material sufficiently hard and durable, such as steel or iron. The mounting spring, similarly, can be made from a number of materials with sufficient strength and durability. Success has been had using a spring for the rear shock absorber of a motorcycle.

Figure 2:
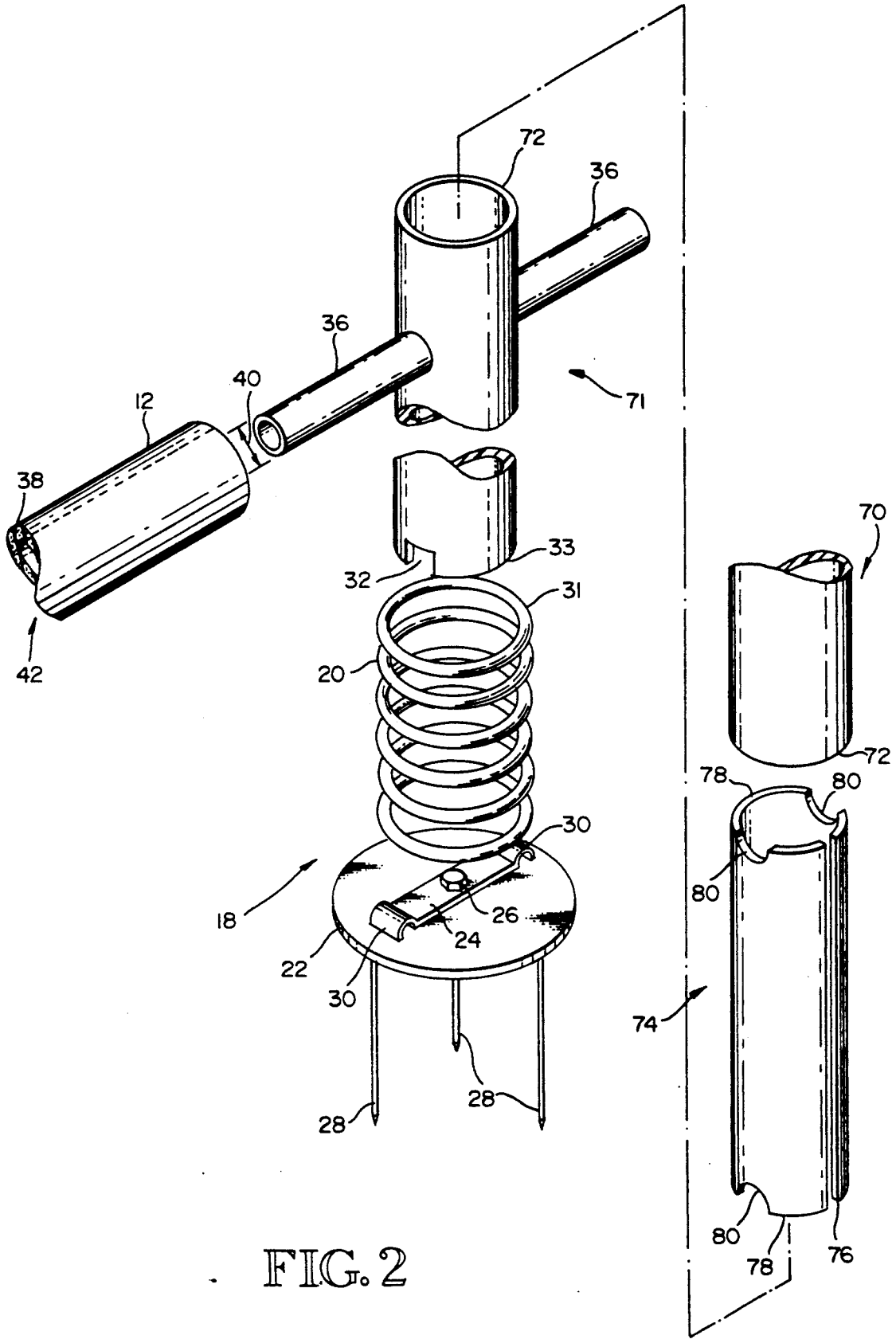
FIG. 2 is a partial, exploded, perspective view of a second alternative preferred embodiment constructed in accordance with the present invention.
Figure 2A:
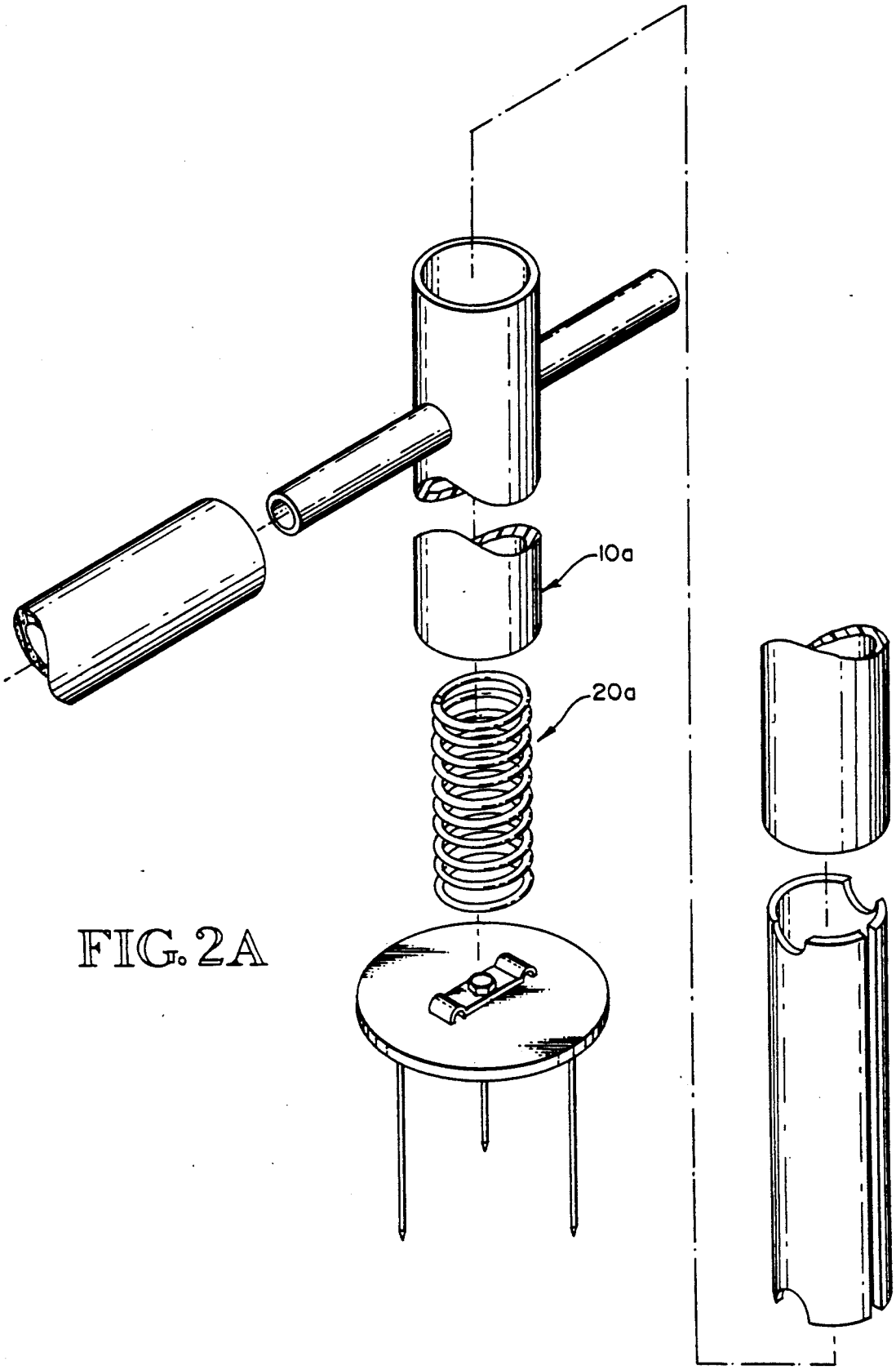
FIG. 2A is a partial, exploded, perspective view of a third alternative preferred embodiment constructed in accordance with the present invention.

While success has been achieved with the mounting system shown above, the mounting system also can work with a mounting spring 20*a* which fits within the central elongated body 10*a*, as shown in FIG. 2A. The primary function of the mounting system regardless of the embodiment used is that it permits the central elongated body to remain in an upright position without requiring the use of external bracing or attachments such as guide wires or ropes which would impede the utility of the training apparatus. For example, instead of a spring, a solid upright rod which would fit within the central elongated body could also be used which would serve essentially the same function. Similarly, although three spikes are shown in FIGS. 2 and 2A, the number can vary to provide a secure base in the ground for the central elongated body with the arms attached.

Figure 2B:
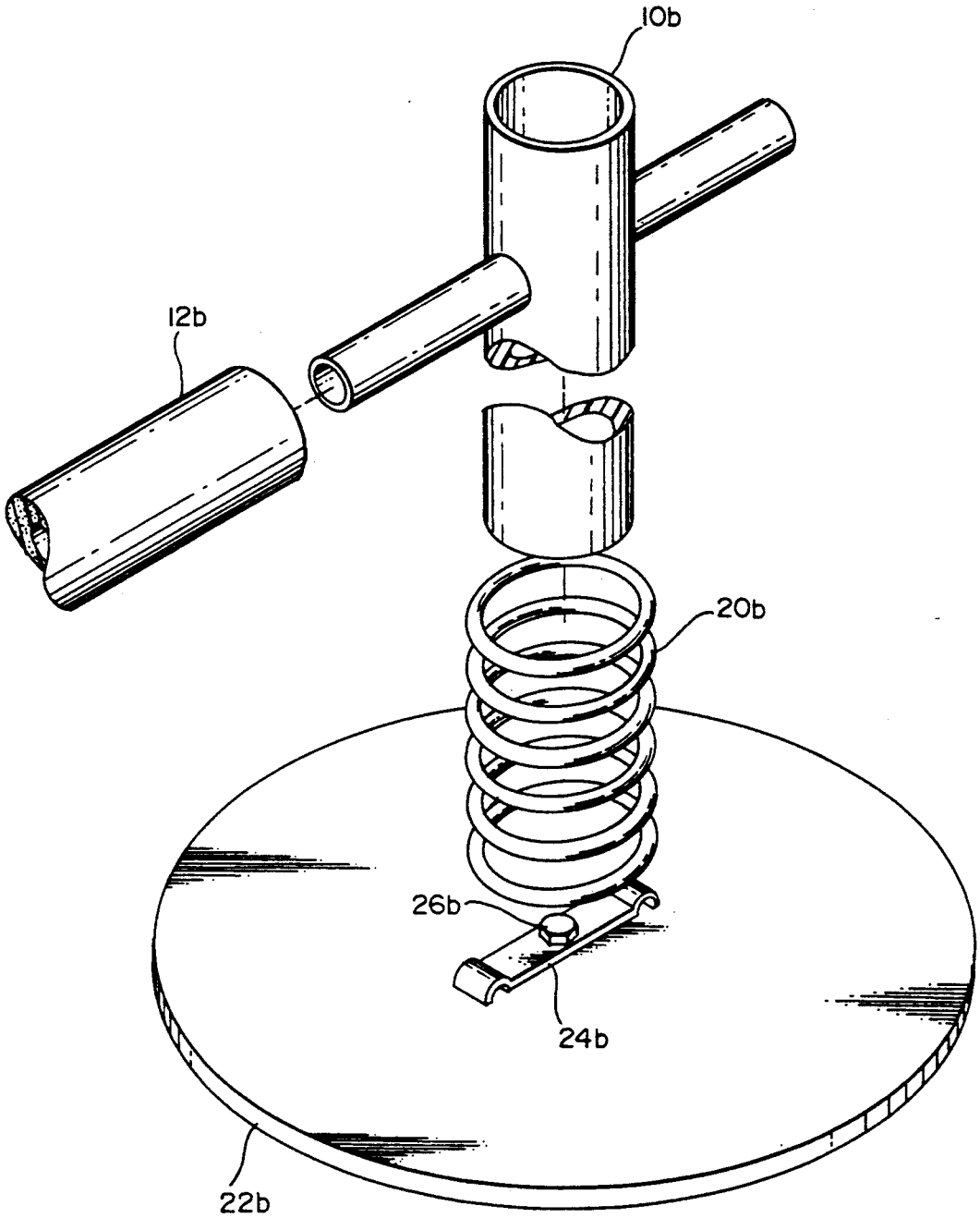
FIG. 2B is a partial perspective view of a fourth alternative preferred embodiment constructed in accordance with the present invention.

The mounting system embodiments are for use with natural turf practice and playing fields. FIG. 2B illustrates an embodiment of the mounting system for use on artificial turf, finished wooden surfaces, or other surfaces which should not be punctured. As with the mounting system embodiments described above, in this embodiment there is a mounting spring 20*b*, a mounting plate 22*b*, a fastening bracket 24*b*, and a fastening nut 26*b*. In this embodiment, however, the mounting plate has a considerably larger diameter than mounting plate 22 and is heavy enough to keep the central elongated body 10*b* and attached barrier arms 12*b* substantially upright without resorting to spikes or other devices that would mar a surface.

Another possible modification of this embodiment uses tires filled with cement, similar to standards used for volleyball nets. The mounting plate can be modified to be attached to the tire, or the central elongated body can be placed directly in a hole in the cement (not shown).

The barrier arms 12 can be permanently attached to the central elongated body 10. Alternatively, for reasons of portability and repairability, it can be useful for the arms to be detachably affixed to the central elongated body. There are a number of ways in which to detachably affix the barrier arms to central elongated body.

One way of detachably affixing the barrier arms 12 to the central elongated body is shown in FIGS. 1 and 2. Holes 34 through the central elongated body 10 are made. Short sections of pipe are placed through these holes to create attachment arms 36. Each of the barrier arms has an interior passage 38 which opens at one barrier arm end 13 at least. The outer diameter 40 of the attachment arm must be greater than the interior diameter 42 of the barrier arm interior passage, but at the same time, allow the barrier arm to be slidable over the attachment arm. After the attachment arm has been put in place the barrier arm interior passage is slipped over the attachment arm.

By constructing the barrier arms 12 from a resilient, relatively elastomeric material, the barrier arm interior passage 38 will expand enough to allow the barrier arm to fit on the attachment arm 36. At the same time, with the proper selection of relative sizes and materials, this embodiment provides sufficient friction to keep the barrier arm from sliding off of the attachment arm without a substantial pulling force being applied on the barrier arm in a direction away from the central elongated body 10. This embodiment for detachably affixing the barrier arms to the central elongated body does not require any external mechanism or tools for the assembly or disassembly of the apparatus.

Figure 1A:
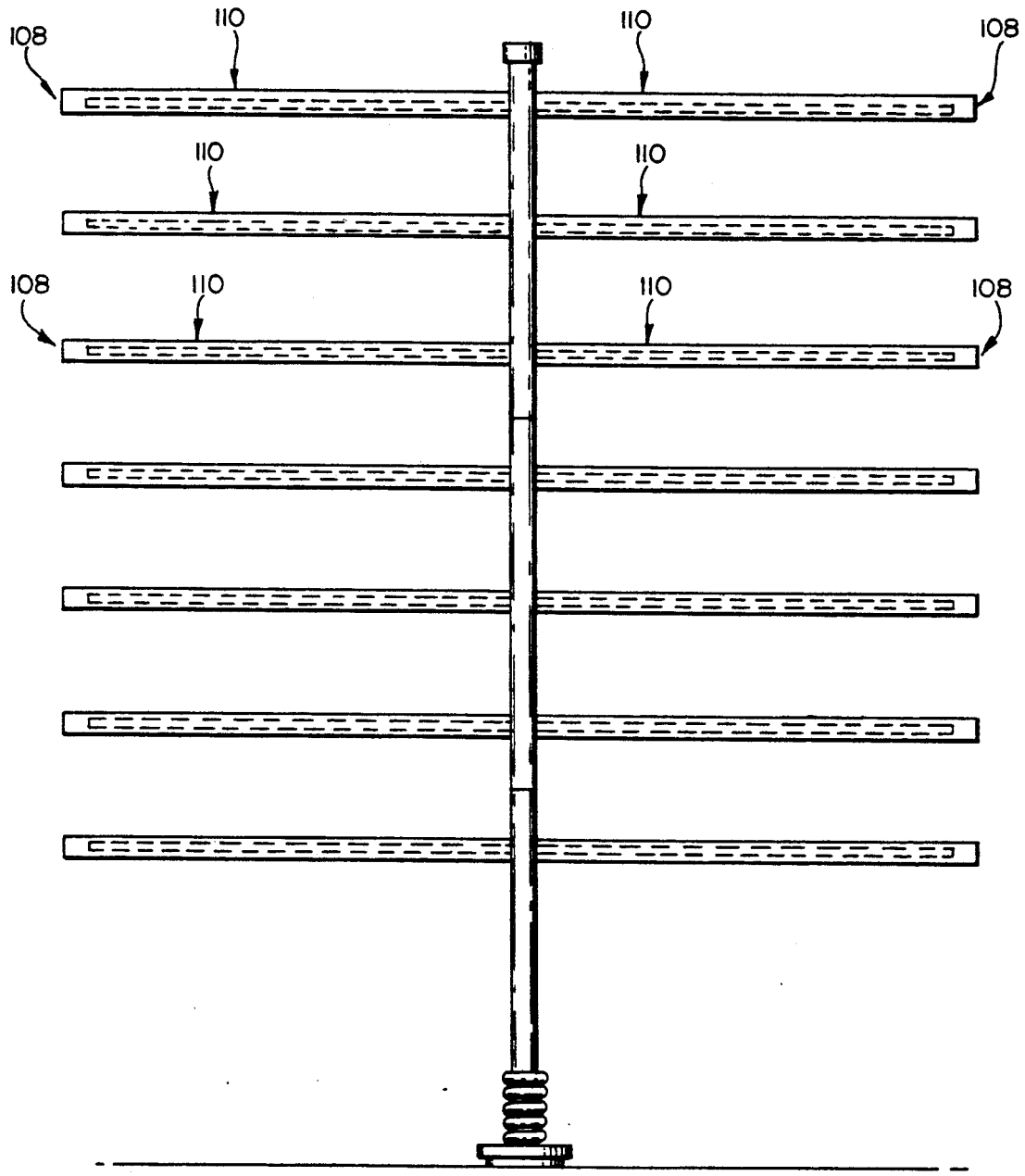
FIG. 1A is a side elevation view of an alternative preferred embodiment constructed in accordance with the present invention.

An alternative preferred embodiment particularly suited for situations in which additional structural strength is desired in the barrier arms 108, such as high temperatures on the practice field, or to increase the deflection of the ball is shown in FIGS. 1A and 8. This embodiment increases the rigidity of the barrier arms by using attachment arm extensions 110.

In this embodiment, the attachment arm extension 110 is a tube made of a suitably stiff material, such as plastics like tenite tubing, which has an outer diameter 112 which allows it to be slid into and frictionally held by the inner diameter 114 of the attachment arm 116. In this embodiment, the barrier arm 108 is placed over the attachment arm extension as well as the attachment arm itself. The attachment arm extension allows the athletic training apparatus to be used in a greater variety of applications than with barrier arms made of a single material.

Figure 5:
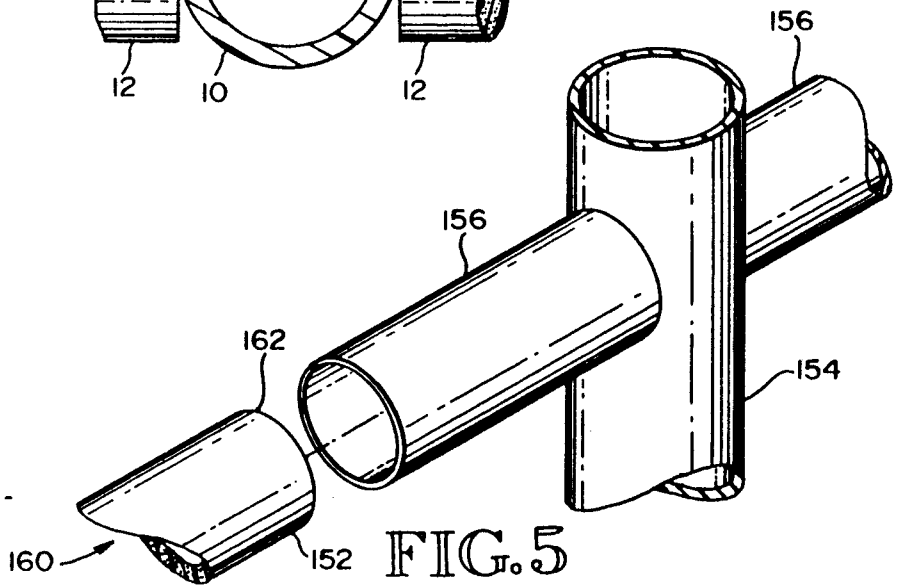
FIG. 5 is a partial perspective view of a fifth alternative preferred embodiment constructed in accordance with the present invention.

Another embodiment for attaching barrier arms 152 to a central elongated body 154 as shown in FIG. 5. The attachment arms 156 have an inner diameter 158 that is larger than the outer diameter 160 of the barrier arm. With this embodiment, the end 162 of the barrier arm is inserted into the attachment arm. The barrier arms in this embodiment would not have to have an interior passage. Similarly, attachment arm extension could be made so that they fit over the attachment arms instead of inside them.

Figure 7A:
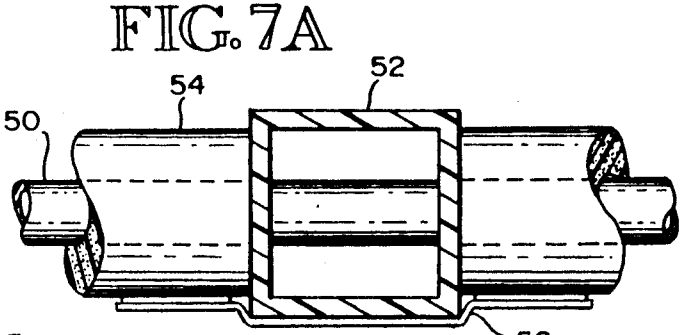
FIG. 7A is a cross section view of an seventh alterative preferred embodiment constructed in accordance with the present invention.

Another way to attach the barrier arms 54 to the central elongated body 52 is shown in FIG. 7A. In this embodiment, as in the above embodiment, there is an attachment arm 50 extending from a central elongated body 52 onto which the barrier arm 54 is placed. This embodiment uses an affixing strap 56 that is attached to the two barrier arms extending from the opposing attachment arms. The attaching strap in this embodiment functions in a manner not unlike that of the string which pulls children's mittens together The attaching strap can use adhesive, hook and loop material, such as Velcro®, snaps, or any number of other methods well known in the art to achieve its hold on the barrier arms.

Regardless of the method used to attach the barrier arms to the central elongated body, the plurality of barrier arms create an apparent barrier to the athlete during practice drills. This apparent barrier serves two functions. First, it obscures the athlete's vision and secondly, it can deflect the ball in motion. As discussed above, both functions require the athlete to improve his concentration on the ball in flight and further require that the athlete concentrate on proper positioning of his hands (or feet) to be able to handle or catch the ball within the shortened reaction time available.

In those applications in which the training apparatus is going to be placed permanently, or at least, infrequently moved, the central elongated body 10 can be one piece. There are situations, however, in which it would be useful for the training apparatus to be broken down in more easily manageable sizes for packaging and transporting the training device when it is initially sold or to travel with the athletic teams using the training device. For these situations, the central elongated body can be made as separate pieces that can be assembled with an assembly system.

One embodiment of the athletic training device that can be broken down into more readily transportable components is shown in FIG. 2. In this embodiment, the central elongated body is broken down into one or more upper sections 70 and a base section 71. At one end 72 of each section there is an inner sleeve 74. The inner sleeve has a longitudinal slot 76 cut through it along its entire length which allows it to be compressed laterally. At either end 78 of the inner sleeve there are a pair of saddle slots 80 that are cut opposite one another on the inner sleeve.

In this embodiment the inner sleeve 78 is compressed along the longitudinal slot 76 which allows it to be inserted into one end 72 of the upper section 70. When the inner sleeve is properly aligned, the saddle slots 80 straddle that section of the attachment arms 36 that fits within the upper section. The inner sleeve is then inserted into the end 72 of the adjacent base section 71 and positioned so that it also straddles that portion of the attachment arm 36 that is within the base section. It should be noted that while assembly between a base section and upper section is herein described and illustrated, the assembly between two adjacent upper sections is identical.

The inner sleeve 74 should be of a length such that when it is inserted between the adjacent ends 72 of the central elongated body sections and pushed so that the saddle slots 80 straddle the attachment arms that are nearest the adjacent ends of the central elongated body sections abut one another. The saddle slots straddling of the attachment arms effectively eliminates rotatation between adjacent central elongated body sections. When used in conjunction with the slots 33 at the central elongated body bottom 32, rotation of the apparatus is virtually eliminated.

While not necessary to the functioning of this assembly system, one end 78 of the inner sleeve 74 can be permanently affixed within the corresponding central elongated body section using glue, rivets or other fixative mechanism. Affixing one end of the inner sleeve in this manner minimizes the number of individual parts that must be dealt with when the apparatus is disassembled. Also, while the inner sleeves described and illustrated herein have longitudinal slots 76, the slot is not necessary if the fit between the central elongated body section and the inner sleeve is sufficiently tight or if the inner sleeve can be held by one of the fixative mechanisms described above.

Figure 6:
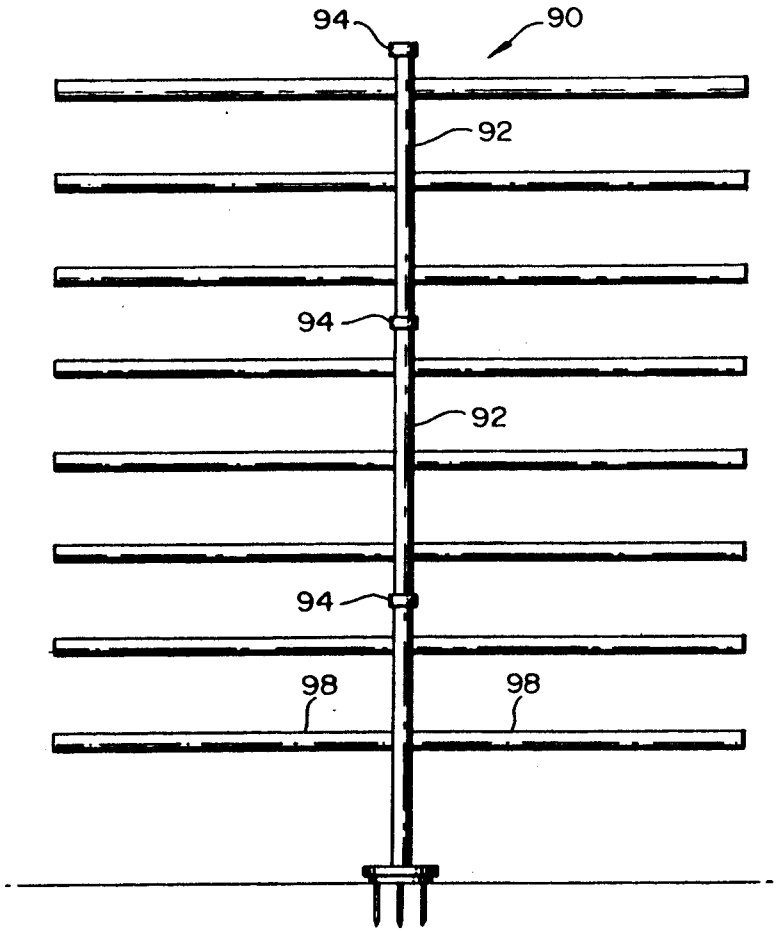
FIG. 6 is a side elevation view of a sixth alternative preferred embodiment constructed in accordance with the present invention.

When the central elongated body 10 described above is used, the only limitations on the height of the resultant assembled training apparatus are the strength of the mounting system and practical limitations as to useful height. FIG. 6 illustrates an alternative embodiment for assembling an athletic apparatus using a central elongated body 90 with individual sections 92. In this embodiment, the abutting ends (not shown) of the adjoining sections slide within a connecting collar 94. As with the inner sleeve of the above embodiment of the assembly system, the connecting collar can be permanently affixed to the corresponding end of the central elongated body section.

Figure 10:
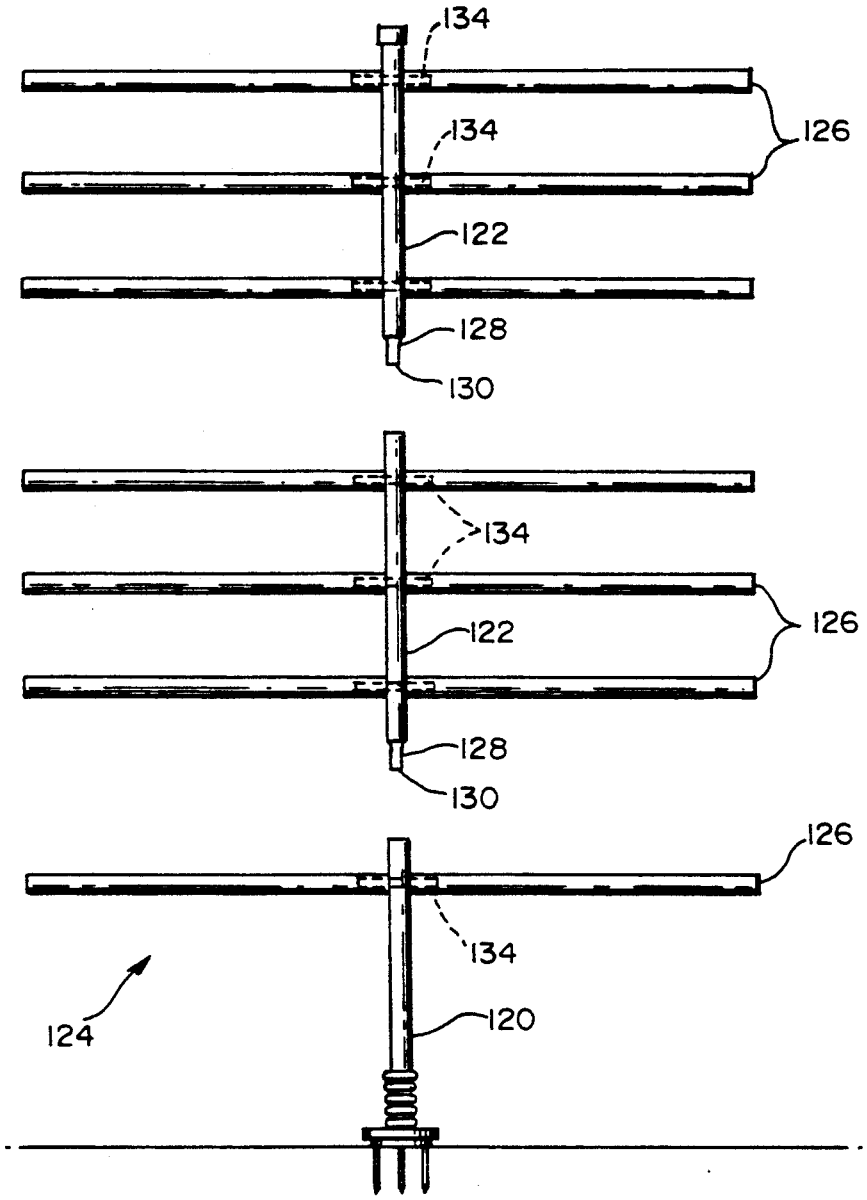
FIG. 10 is a partial, exploded, perspective view of an tenth alternative preferred embodiment constructed in accordance with the present invention.

Another alternative preferred embodiment of the present invention which uses yet another way to assemble and disassemble the central elongated body is shown in FIG. 10. This embodiment also has a base section 120, and multiple upper sections 122 that make up a central elongated body 124 with a plurality of barrier arms 126 attached. Each of the upper sections in this embodiment has a tapered end 128 with saddle slots 130. The tapered end is sufficiently narrow to fit within an untapered end 132 of the base section or an adjacent upper section. As with the inner sleeve embodiment, the length of the tapered end is such that when inserted into an adjacent section, the saddle slots will straddle the portion of the attachment arms 134 within the section to improve the structural rigidity.

The central elongated body of preferred embodiments as well as the attachment arms can be made from polyvinylchloride, aluminum, ABS, or any other lightweight plastic or material as long as the material is relatively light, resilient, and sufficiently rigid to retain its shape while withstanding the inevitable blows that will occur during training drills. Success has been had with both polyvinylchloride and ABS. While it is not essential that the central elongated body or the attachment arms be hollow, practical limitations with respect to material costs and weight as well as safety factors will probably dictate that the bodies be substantially hollow.

Figure 7:
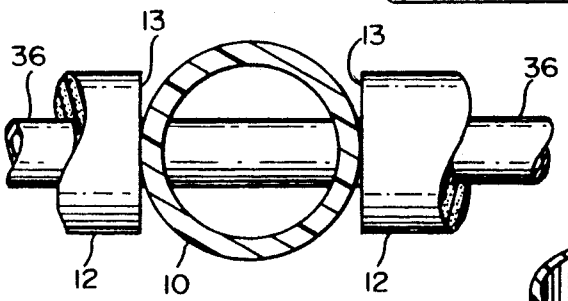
FIG. 7 is a top cross section view of a preferred embodiment constructed in accordance with the present invention taken along lines 7—7 in FIG. 1.

The central elongated body 10 in the embodiment shown in FIG. 7 has a cross section that is circular in shape. However, the central elongated body 52 shown in FIG. 7A, shown has a cross section that has a square shape. There is virtually no limitation as to the cross sectional shape available; for example, ovular, rectangular, hexagonal, octagonal, etc. The only limitations as to cross sectional shape for the central elongated body would be dictated by practical considerations, such as integral strength and cost of production.

The barrier arms can be produced of any material that is resilient, flexible and durable. The consistency of the material for the barrier arms will probably be somewhat less stiff than that of the central elongated body since as is discussed below, athletes will be running into and through the apparent barrier created by the plurality of barrier arms. At the same time, the barrier must be sufficiently stiff to deflect the path of a thrown or kicked ball to obtain the desired training effect in the drill. Success has been achieved using the commercially available materials Climatube and ThermAcell.

There is one other limitation on the material used to create the barrier arms. Since it is likely that this athletic training device will be used in areas where summer temperatures can reach in excess of 100 degrees Fahrenheit, the barrier arms must be made of a material that will retain its structural integrity in these temperatures. There is a problem with some plastic and rubber materials in that they droop when heated to these temperatures. This would render the athletic device relatively dysfunctional. In addition to the selection of the proper materials, this problem can be addressed also by the use of attachment arm extensions 110 as discussed above.

The training apparatus can be built with virtually any dimensions desired as long as they allow the athletic training device to be assembled and used. While in no way limitations on those dimensions, by way of example of one successful application, the following dimensions were used for a particular example of a training apparatus that has been used for sports such as football. The central elongated body had a base section 71 that is 36.0 inches (91.4 centimeters) tall and two upper sections 70 that are 30.0 inches (76.2 centimeters) tall. Each of the sections has an outer diameter of 2.0 inches (5.1 centimeters). The attachment arms have an outer diameter of 0.75 inches (1.9 centimeters) and are 6.0 inches (15.2 centimeters) long. The barrier arms are 36.0 inches (91.4 centimeters) long and have an outer diameter of 1.75 inches (4.4 centimeters) and an inner passage diameter of 0.5 inches (1.3 centimeters). The attachment arm extension that can be used with those applications is 30.0 inches (76.2 centimeters) long with an outer diameter of approximately 0.75 inches (1.91 centimeters). Spacing between the attachment arms, and thereby the barrier arms, is 10.0 inches (25.4 centimeters) with the first pair of opposing barrier arms being 31.0 inches (78.7 centimeters) above the central elongated body bottom. Additional barrier arms can be added to the base section down to approximately 11 inches (27.9 centimeters) or even less. An apparatus constructed using those dimensions can be broken down with no individual piece being more than 36.0 inches (91.4 centimeters) long, which translates into easy portability and transportation, as well as quick trouble-free assembly without need for any separate tools or other assembly apparatus.

The embodiments discussed so far have utilized a plurality of barrier arms organized into two sets that are approximately 180 degrees apart form one another and substantially normal to the central elongated body. None of these embodiments are or should be construed as limitations on the present invention. As shown in FIG. 9, sets of barrier arms 130 can be set at other angles relative to one another, such as approximately 120 degrees. As shown in FIG. 9A, there can be several sets of barrier arms. Other possible variations are that the barriers arms may not be substantially normal to the central elongated body or the plurality of barrier arms may not be organized into sets of arms at all and instead are attached at various locations on the central elongated body.

Figure 3:
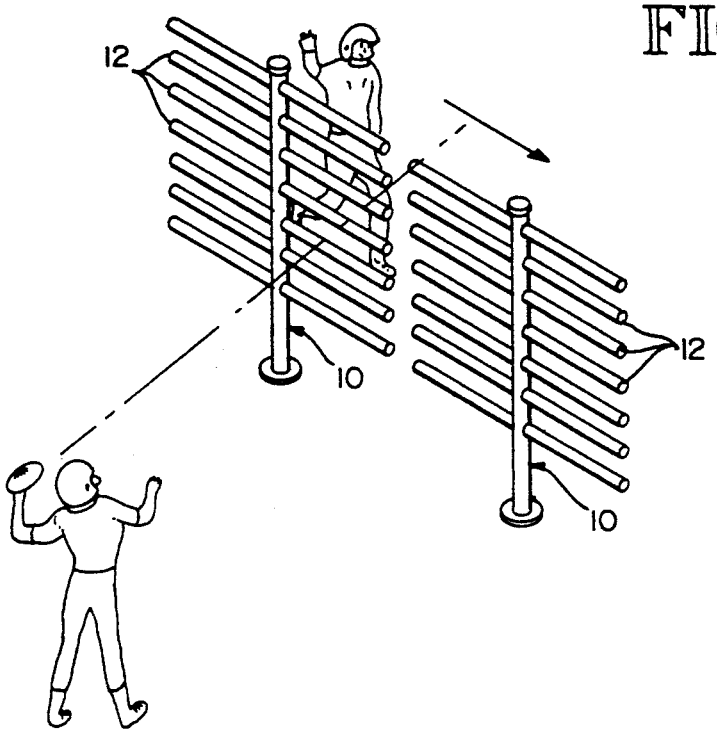
FIG. 3 is a perspective environmental view of a preferred embodiment constructed in accordance with the present invention.
Figure 4:
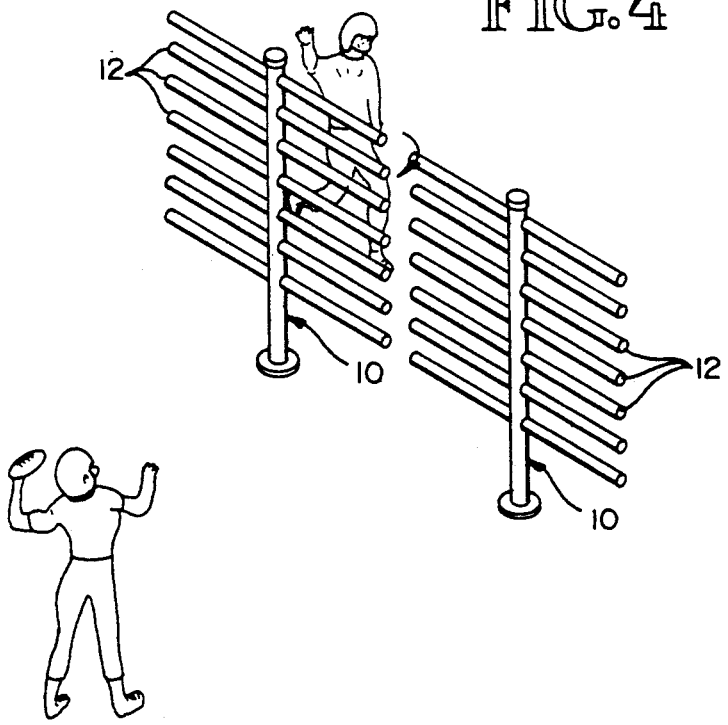
FIG. 4 is another perspective environmental view of a preferred embodiment constructed in accordance with the present invention.

As shown in FIGS. 1, 3, and 4, a number of embodiments of the present invention use more than one central elongated body 10 with the affixed barrier arms 12. While such embodiments allow a great deal of flexibility and versatility in the use of the apparatus, the apparatus can completely fulfill its goal of athletic training with a single central elongated body and affixed barrier arms.

Figure 11:
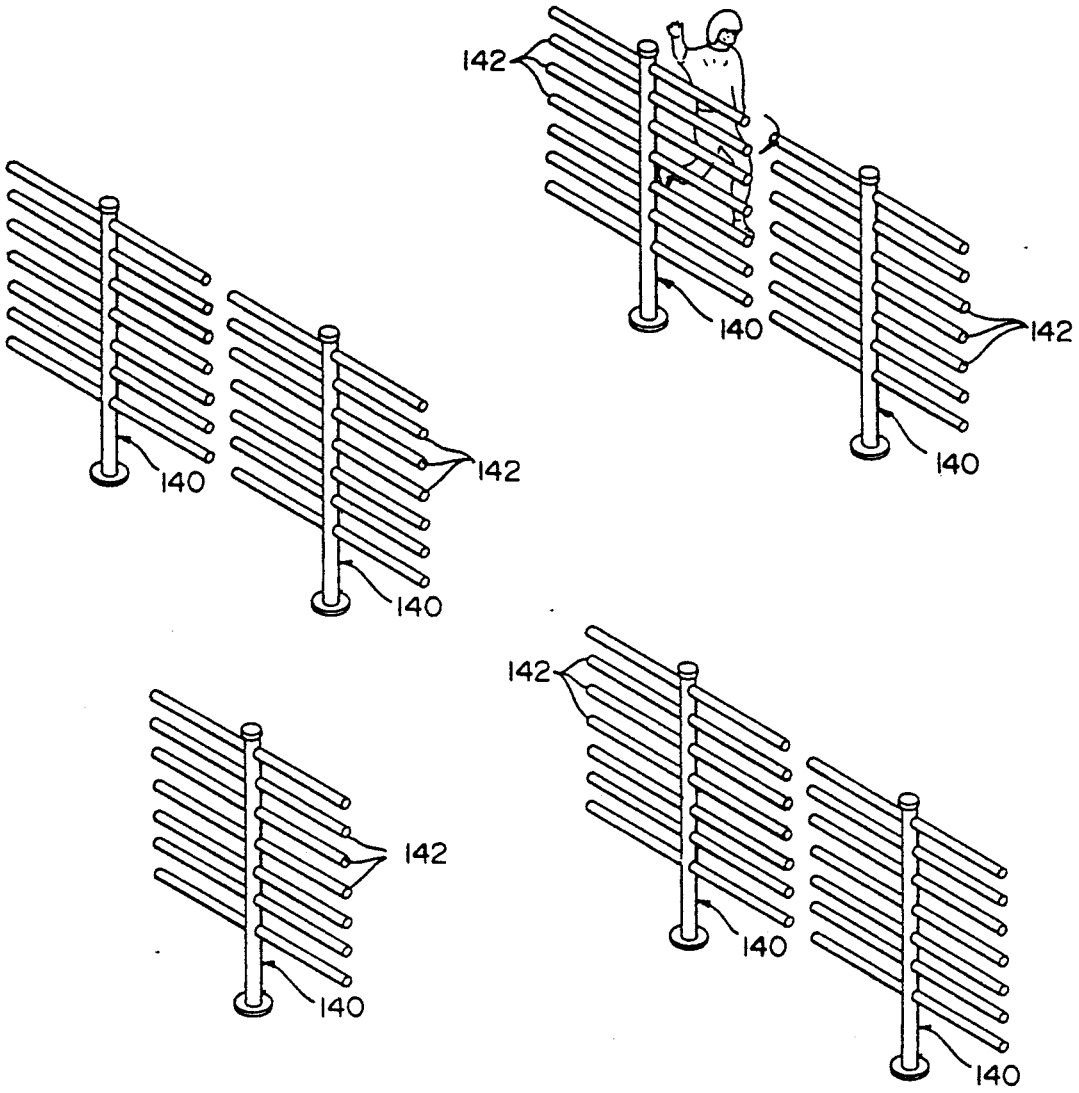
FIG. 11 is a perspective environmental view of a eleventh alternative preferred embodiment constructed in accordance with the present invention.
Figure 11:
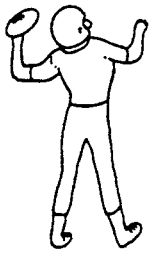

The alternative preferred embodiment of the athletic training apparatus as illustrated in FIG. 11, shows more than two central elongated bodies 140 with affixed barrier arms 142. The embodiment of the apparatus shown in FIG. 11 has a number of central elongated bodies with the affixed barrier arms placed at predetermined positions across the playing field. This allows the athlete throwing the ball to direct the athlete who is to handle or catch the ball to one of a number of positions. This variety in the training drill increases the training value both to the athlete throwing the ball and to the athlete handling or catching the ball.

As illustrated in FIGS. 3, 4, and 11, the embodiments of the training apparatus and method in accordance with the present invention allows for strict repeatability as to the direction the ball is to be thrown or kicked, and the timing, distance, and cuts that make up the patterns that the receiver athlete is to run. At the same time, the apparent barrier obscuring the receiver athlete's vision and possibly deflecting of the ball in motion by the barrier arms introduces the unpredictability which also achieves the desired training effect of forcing the athlete to preposition and react with his hands, or as for a non-goalie soccer player, with his feet, as opposed to his body.

While the dimensions given above are very suitable for sports in which the path of the ball in flight is assumed to be at least 24.0 to 30.0 inches above ground level, in certain sports such as baseball or soccer it is common and desirable for the ball to be at or near ground level. FIG. 6 illustrates an embodiment of the present invention is which the lowest pair of opposed barrier arms 98 are less than 12.0 inches (30.5 centimeters) above ground level, which would enable balls kicked or thrown just above ground level to be deflected as described above.

INDUSTRIAL APPLICABILITY

This invention would be useful in any situation where it is desirable to have a method or device to train athletes to improve the athletes' ability to track and handle or catch a ball, especially in the situations where portability and adaptability of the training method and apparatus is important.

In compliance with the statute, the invention has been described in language more or less specific as to structural features. It is understood, however, that the invention is not limited to the specific features shown, since the means and construction herein disclosed comprise preferred forms putting the invention to effect. The invention is claimed therefore in any of its forms or modifications within the legitimate and valid scope of the appended claims.

I claim:

1. An apparatus for training athletes to improve their ability to concentrate on, track, and handle or catch a ball in motion, wherein said apparatus comprises:

at least one central elongated body, said central elongated body having a length and two ends;

a plurality of barrier arms for each said central elongated body, said barrier arms extending out form and arrayed along said central elongated body, said barrier arms having a length and two ends, and further being made of a flexible material;

a mounting system for each said central elongated body, said mounting system being attached to said central elongated body and allowing said central elongated body to remain in a substantially vertical position without the use of external supports;

a first set and a second set of said barrier arms for each said central elongated body, said first set and said second set of said barrier arms being formed form said barrier arms making up said plurality to said barrier arms, said arms of each said set being substantially aligned with one another along said central elongated body, and substantially normal to said central elongated body; and an arm attachment system for each said central elongated body, each said barrier arm being detachably attached to said central elongated body by said arm attachment system.

2. An apparatus for training athletes as claimed in claim 1, wherein said apparatus further comprises:

a mounting plate, said mounting plate being substantially flat and having at least one spike extending downward from said mounting plate so that when said spike is driven into a turf surface, said mounting plate will be affixed to an substantially parallel to said turf surface; and a mounting spring, said mounting spring being coiled and having two ends, and said mounting spring further being attached to said mounting plate with one said end being open and oriented upward, and said mounting spring having a size so that one said end of said central elongated body will slidably fit within said spring and said central elongated body will be held in substantially vertical position.

3. An apparatus for training athletes as claimed in claim 2, wherein said first set of said barrier arms and said second set of said barrier arms extend outwardly from said central elongated body opposite one another so that said barrier arms of said first set and said second set are approximately 180 degrees from one another.

4. An apparatus for training athletes as claimed in claim 3, wherein each said central elongated body further comprises:

a base section, said base section being substantially hollow and having two ends, one said base section end slidably fitting into said mounting spring open end;

at least one upper section, each said upper section being substantially hollow and having two ends; and an assembly system, said assembly system allowing said base section and each said upper section to be joined together to form said central elongated body and then to be taken apart repeatedly.

5. An apparatus for training athletes as claimed in claim 4, wherein said arm attachment system further comprises:

each said barrier arm having an interior passage, said interior passage extending longitudinally within each said barrier arm and, further having an opening in at least one said end of said barrier arm; and a plurality of attachment arms, at least one said attachment arm for each said barrier arm with said attachment arm extending out from and along said central elongated body, each said attachment arm having a length and two ends and further being located where one said barrier arm is attached to said centrally elongated body, each said attachment arm further having an outer diameter greater than a diameter of said barrier arm interior passage, with each said barrier arm slidably fitting over one said attachment arm.

6. An apparatus for training athletes as claimed in claim 5, wherein said arm attachment system further comprises a plurality of attachment arm extensions, each said attachment arm extension having a length and two ends, and further with one said attachment arm extension for each said attachment arm, each said attachment arm extension fitting one said end to one said attachment arm end and allowing said barrier arm to slidably fit over said attachment arm extension and corresponding said attachment arm so that said barrier arm has additional structural strength.

7. An apparatus for training athletes as claimed in claim 6, wherein said assembly system further comprises at least one inner sleeve, each said inner sleeve having a length and two ends and slidably fitting into said upper section ends and said end of said base section not fitting into said mounting spring open end, so that said central elongated body can be assembled by placing one said inner sleeve between and into adjacent said ends of said base section and said upper section and between and into adjacent said ends of said upper sections, and said base section and said upper section ends are pushed together.

8. An apparatus for training athletes as claimed in claim 1, wherein said arm attachment system further comprises:

each said barrier arm having an interior passage, said interior passage extending longitudinally within each said barrier arm and, further having an opening in at least one said end of said barrier arm; and a plurality of attachment arms, at least one said attachment arm for each said barrier arm with said attachment arm extending out from and along said central elongated body, each said attachment arm having a length and two ends and further being located where one said barrier arm is attached to said centrally elongated body, each said attachment arm further having an outer diameter greater than a diameter of said barrier arm interior passage, with each said barrier arm slidably fitting over one said attachment arm.

9. An apparatus for training athletes as claimed in claim 8, wherein said arm attachment system further comprises a plurality of attachment arm extensions, each said attachment arm extension having a length and two ends, and further with one said attachment arm extension for each said attachment arm, each said attachment arm extension fitting one said end to one said attachment arm end and allowing said barrier arm to slidably fit over said attachment arm extension and corresponding said attachment arm so that said barrier arm has additional structural strength.

10. An apparatus for training athletes as claimed in claim 1, wherein each said central elongated body further comprises:

a base section, said base section being substantially hollow and having two ends, one said base section end slidably fitting into said mounting spring open end;

at least one upper section, each said upper section being substantially hollow and having two ends; and an assembly system, said assembly system allowing said base section and each said upper section to be joined together to form said central elongated body and then to be taken apart repeatedly.

11. An apparatus for training athletes as claimed in claim 10, wherein said assembly system further comprises at least one inner sleeve, each said inner sleeve having a length and two ends and slidably fitting into said upper section ends and said end of said base section not fitting into said mounting spring open end, so that said central elongated body can be assembled by placing one said inner sleeve between and into adjacent said ends of said base section and said upper section and between and into adjacent said ends of said upper sections, and said base section and said upper section ends are pushed together.

* * * * *